United States Patent [19]

Lawes

[11] 4,073,429

[45] Feb. 14, 1978

[54] PLASTICS BAG

[75] Inventor: Norman Edward Lawes, Yarm, England

[73] Assignee: Imperial Chemical Industries Limited, London, England

[21] Appl. No.: 698,220

[22] Filed: June 21, 1976

[30] Foreign Application Priority Data

| | | |
|---|---|---|
| July 3, 1975 | United Kingdom | 28046/75 |
| Aug. 6, 1975 | United Kingdom | 32850/75 |
| Jan. 23, 1976 | United Kingdom | 2696/76 |

[51] Int. Cl.[2] ..... B65D 31/14

[52] U.S. Cl. ..... 229/62.5

[58] Field of Search ..... 229/62.5; 150/9

[56] References Cited

U.S. PATENT DOCUMENTS

| | | | |
|---|---|---|---|
| 2,040,338 | 5/1936 | Rosmait | 229/62.5 |
| 3,746,246 | 7/1973 | Murray | 229/62.5 |
| 3,812,769 | 5/1974 | Barnes et al. | 229/62.5 X |
| 3,833,166 | 9/1974 | Murray | 229/62.5 |

FOREIGN PATENT DOCUMENTS

| | | | |
|---|---|---|---|
| 650,048 | 7/1963 | Belgium. | |
| 709,244 | 5/1965 | Canada | 229/62.5 |
| 1,436,858 | 12/1968 | Germany | 229/62.5 |
| 2,213,908 | 10/1972 | Germany | 229/62.5 |
| 1,401,713 | 7/1975 | United Kingdom | 229/62.5 |

*Primary Examiner*—Stephen P. Garbe

*Attorney, Agent, or Firm*—Cushman, Darby & Cushman

[57] ABSTRACT

A plastics-film bag having one wall formed by overlapping panels joined by a longitudinal seal, and having a filling valve constituted by a passageway left between the panels, in which at least one additional layer of film or other flexible material is included between the panels in the overlap, to improve the security of the valve.

10 Claims, 10 Drawing Figures

PLASTICS BAG

This invention relates to valved plastics bags.

It is already generally known to form valved plastics bags from a flat web folded to provide overlapping panels, the panels being joined together by two essentially parallel longitudinal seals, and the ends of the bag also being sealed, but a passageway of a width required to provide a filling opening, or valve, being left between the panels, by interruption of the two parallel seals. The valve is further defined by transverse seals between the panels. Such a bag is described in United Kingdom Specification No. 956,599.

United Kingdom Specification No. 1,367,001 describes and claims a multi-wall, valved plastics bag of such type, in which the panels are designed in a specified manner to provide security of the valve against sifting of contents from the bag. In a preferred form, this is a two-ply plastics bag in which the inner layer of the inner panel in the area of overlap extends beyond the outer layer.

The present invention concerns a modification of a bag of this general type by which the nature of the valve may be improved in certain respects.

The present invention provides a valved bag formed from a length comprising at least one layer of plastics film, the length being folded and joined to provide a bag having one wall formed by overlapping panels, the ends of the bag being closed, and the overlapping panels being joined together by a longitudinal seal located with respect to the outer panel along the edge region thereof, this seal being interrupted to provide a valve opening, and by transverse seals at each side of the valve opening, said transverse seals defining a passageway constituting a filling valve between the panels, characterized in that there is included among the layers of film in the area of overlap, at least throughout the valve region, at least one layer of flexible material additional to the layer or layers forming the folded length, said additional layer or layers being joined with the panels into the transverse seals and preferably also into said longitudinal seal, and in that the inner panel and said additional layer or layers provide, in the area of overlap, at least three layers extending non-coextensively along the valve passageway.

The valve opening may be located at one end of the bag, in which case one of the said transverse seals across the area of overlap may be provided as a portion of a seal closing that end of the bag. The bag may be side-gusseted if desired.

The invention gives the particular advantage that it can provide greatly improved security of the valve, such that the bags may be used to contain liquids or flowable semi-solid substances, even when the bags are of high capacity, for example of a capacity of at least 5 liters, and especially of 10 liters or more. The bags, particularly when they are of such high capacity, are also useful for containing free-flowing powders or granules, especially when these are of corrosive substances such as caustic soda. The invention will even allow bags in the form of heavy-duty plastics-film sacks containing, for example, 20 or 25 liters of liquid, to be loaded on to pallets and subjected to other normal bag-handling methods without leakage of the contents.

A further advantage arising from the invention is that the bags can be made in a very simple manner by a continuous process. Thus, they may be made by an adaptation of the method generally used in "back-seal" bag manufacture, which consists of longitudinally folding a continuous web comprising at least one layer of plastics film, sealing the overlapping areas together longitudinally and transversely as required for successive bags, and sealing and severing the ends of successive bags at the appropriate intervals of one bag length. The adaptation consists of feeding-in further strips or patches of film. between the appropriate layers of the overlapping panels, before the panels are sealed together. It is to be understood that the terms "length" and "width", and related terms, are generally used in the context of bag manufacture, and will be used throughout this specification, in relation to the web from which the bags are made, rather than to the dimensions of an individual bag as such. Thus, for example, the "length" of film folded to form a bag is measured in the machine direction of the web; it may be, and generally will be, less than the initial width of the web. It follows that in the individual bag the "width" may sometimes be greater than the "length" (which is the distance from one line of severance to the other) and an "end" longer than a "side".

The overlapping panels are preferably joined additionally by a second longitudinal seal located with respect to the inner panel towards the edge thereof and interrupted at the filling valve, the corresponding ends of the two longitudinal seals then preferably being joined by the two transverse seals. This arrangement will often give added security to the valve and added strength to the bag.

The bag may be a single-ply plastics-film bag or a multi-ply bag. It may with particular advantage be a modification of a two-ply plastics-film bag of the type described in United Kingdom Specification No. 1,367,001, having coextensive plies in the outer panel of the overlap, this panel preferably being edged by a fold, and having one ply of the inner panel extending beyond the other ply, both plies being joined to the outer panel by the longitudinal seal located at the edge of the outer panel, but the inner ply extending to provide the inner wall of the filling valve, being joined into the said transverse seals and, except at the valve, preferably being also joined at its edge to the outer panel, by a second longitudinal seal. The, or each, said further layer provided in the valve in accordance with the present invention then preferably lies with one of its edges between the two plies of film of the inner panel and with its other edge projecting beyond the edge of the outer layer of the inner panel but lying short of the edge of the inner layer, and is joined, at each side of the valve, at least into the said transverse seals, and preferably also into the first longitudinal seal.

In one preferred embodiment of the invention, a J-folded strip of plastics film or other flexible material is used to provide two additional layers in the valve, the margin thereof that contains the fold being joined into the longitudinal seal located at the edge of the outer panel, and the two free edges of the folded strip projecting unequally into the valve. In a two-ply bag of such form the J-folded strip is positioned with its fold lying between the two layers of the inner panel, both its free edges project beyond the edge of the outer layer of the inner panel, but stop short of the inner layer thereof, and the shorter portion of the J is adjacent to the outer layer.

As an alternative to the bags being used in an unsupported form, they may be used, especially in the packaging of liquids, as liners for stiff casings such as boxes, cartons or drums, the valve being located at one end of the bag, or at or towards the centre thereof, as may be most appropriate to the position of the opening of the casing. When the casing is box-shaped, it is usually advantageous to use as the liner a side-gusseted bag opening out to a substantially similar shape.

The invention will now be more particularly described by way of example with reference to the accompanying drawings, of which:

The film layers in the sections are shown as single lines.

Figure 1:
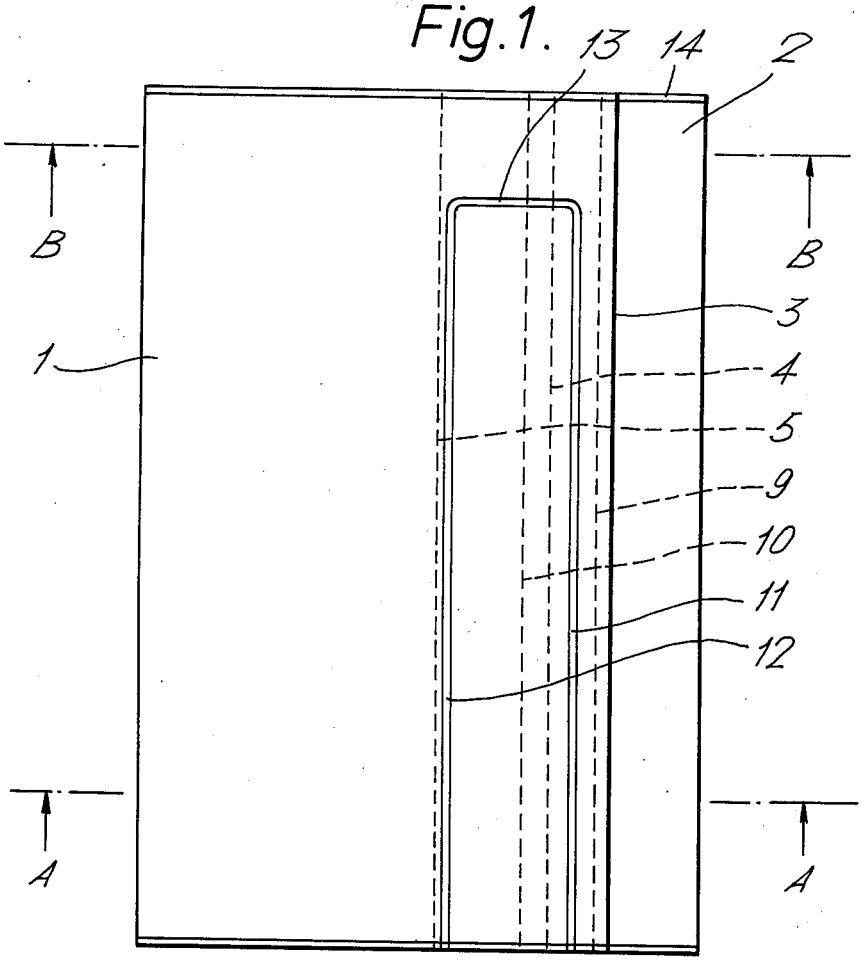
FIG. 1 is an elevational view of a two-ply bag having a single additional layer of flexible material between the film layers of the inner panel in the area of overlap, and having a valve at one end.
Figure 2:
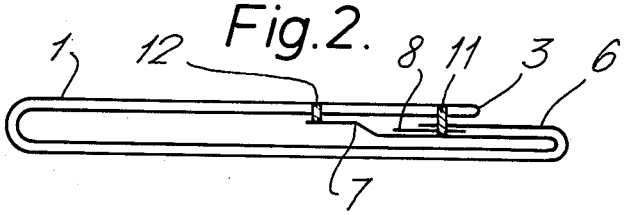
FIG. 2 is a section through A—A of FIG. 1.
Figure 3:
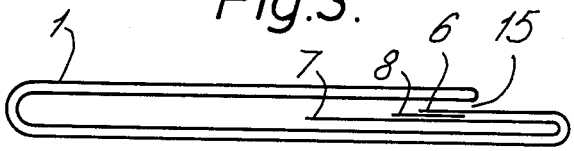
FIG. 3 is a section through B—B of FIG. 1.

In FIGS. 1 to 3 : 1 is the outer panel and 2 is the inner panel of the front wall of the bag; 3 is a fold joining the inner and outer layers of the outer panel; 4 and 5 are respectively the edges of the outer layer, 6, and of the inner, extending layer, 7, of the inner panel; and 8 is a strip of flexible material, one edge, 9, of which is interposed between the layers of the inner panel 2 while the other edge, 10, projects beyond the edge, 4, of the outer layer of this panel, but lies short of the edge, 5, of the inner layer. 11 and 12 are the two legs, and 13 is the arch, of a U-shaped heat-seal joining all layers in the area of overlap, the leg 11 thus joining together the two layers of the outer panel 1, the two layers of the inner panel 2, and the interposed strip of film, 8, and the leg 12 joining together the two layers of the outer panel and the inner layer of the inner panel only. Between the arch, 13, of the U-shaped seal and a heat-seal, 14, closing the end of the bag, the layers in the area of overlap are left unjoined to leave a transverse passageway, with an entry shown at 15 (FIG. 3), which provides a filling valve.

Figure 4:
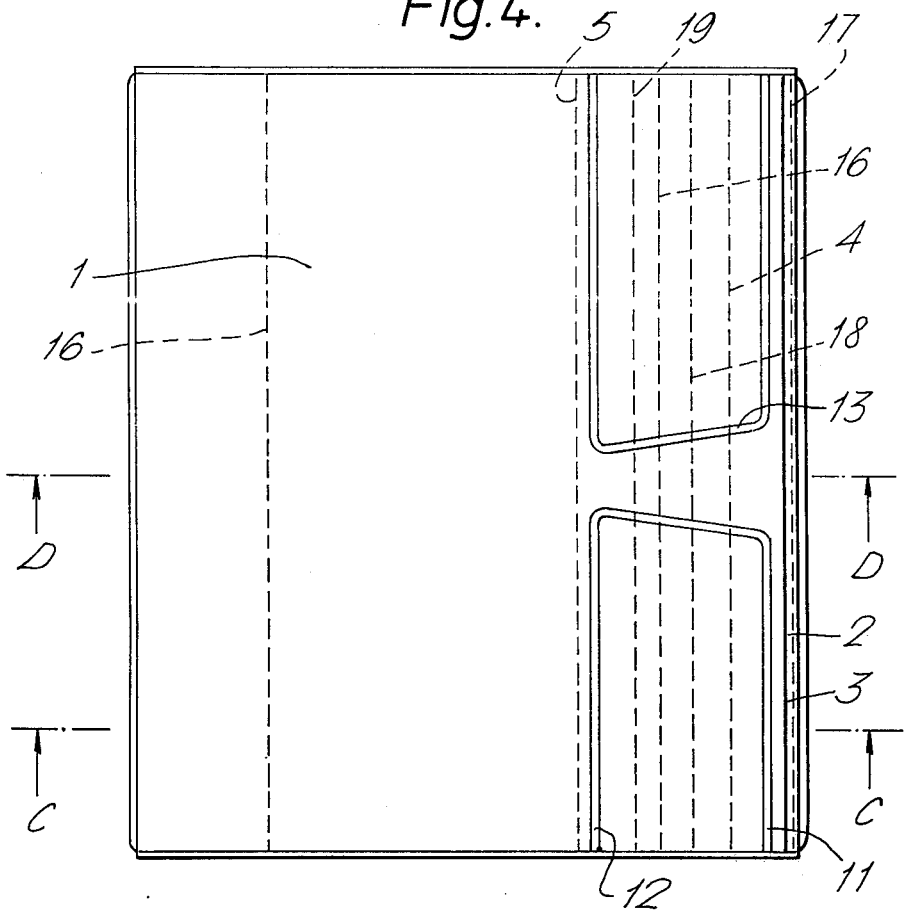
FIG. 4 is an elevational view of a two-ply, side-gusseted bag having a J-folded additional strip of flexible material between the layers of the inner panel, and having a valve centrally located at one side of the bag.
Figure 5:
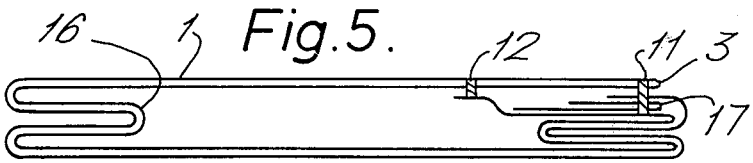
FIG. 5 is a section through C—C of FIG. 4.
Figure 6:
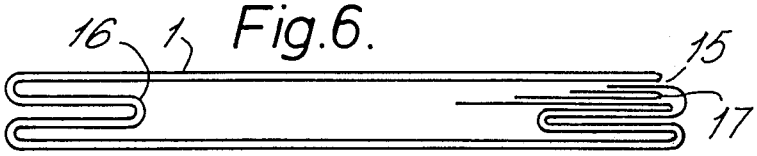
FIG. 6 is a section through D—D of FIG. 4.

In FIGS. 4 to 6 the arrangement of the overlapping panels is similar, but the bag is side-gusseted, the inside folds of the gussets being shown at 16, and instead of a single-layer strip of film a J-folded strip is interposed between the outer and inner layers of the inner panel, with its fold, 17, lying between the layers, and its two edges 18, 19, projecting beyond the edge, 4, of the outer layer of the panel but each lying short of the edge, 5, of the inner layer, and the shorter arm of the J-folded strip lying adjacent to the outer layer of the inner panel. Instead of a single U-shaped seal, two similar seals are provided, with arms 11 and 12, and with arches 13, which provide transverse seals defining the filling valve, the entry of which is again shown as 15 (FIG. 6). The position of this valve makes the bag of FIGS. 4 to 6 particularly useful as a liner for a box, carton or other container, suitable for containing a semi-solid or liquid product.

Figure 7:
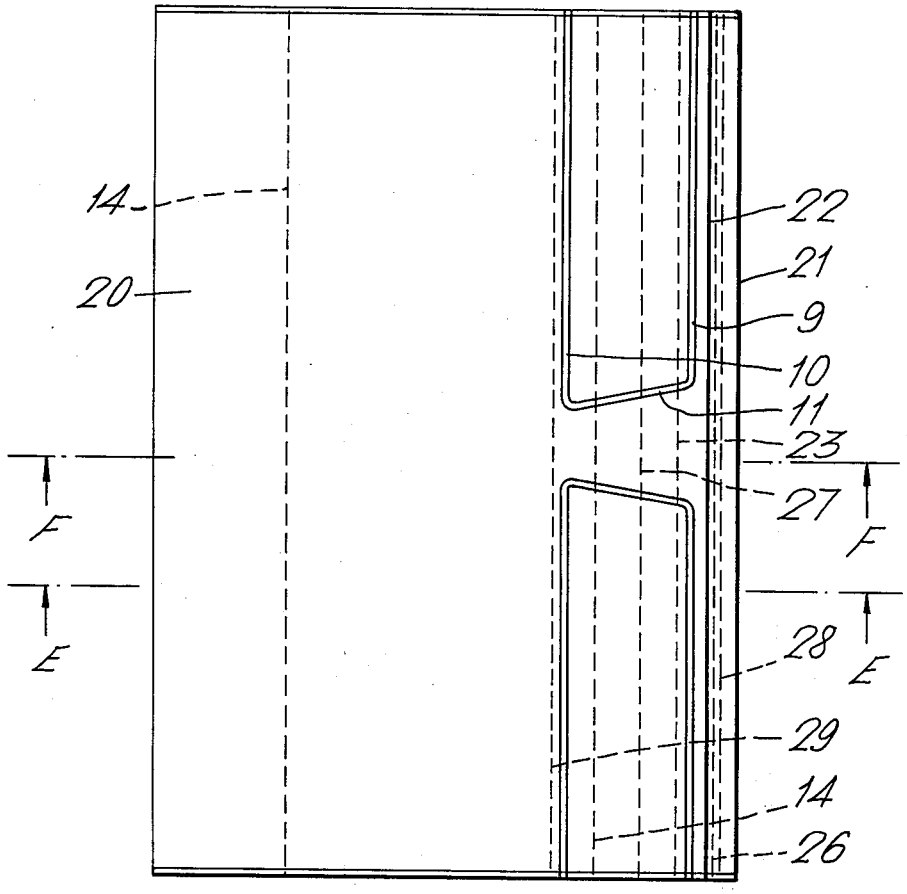
FIG. 7 is an elevational view of a single-ply bag having three two layers in the area of overlap, and having a centrally-located valve.
Figure 8:
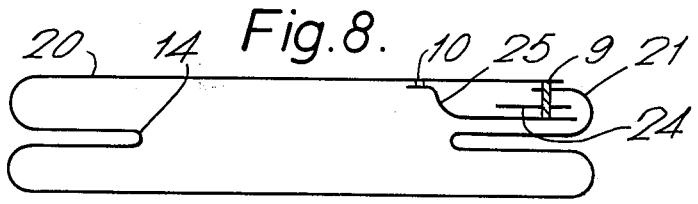
FIG. 8 is a section through E—E of FIG. 7.
Figure 9:
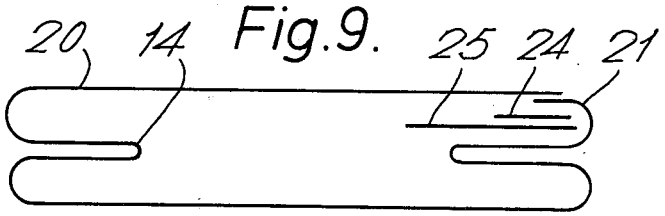
FIG. 9 is a section through F—F of FIG. 7.

In FIGS. 7 to 9 : 20 is the outer panel and 21 is the inner panel of the front wall of the single-ply bag, the edge of the outer panel being shown at 22 and the edge of the inner panel at 23. 24 and 25 are two strips of plastics film each having one edge underlying the edge of the inner panel, and the other projecting beyond the edge of the inner panel towards the middle of the bag. The edges of strips 24 and 25 are shown at 26, 27 and 28, 29 respectively. Thus, each side edge of the inner strip, 25, extends beyond the corresponding edge of strip 24. 9, 10, and 11 are again the parts of substantially U-shaped seals joining together the appropriate layers of film in the area of overlap: thus, panels 20 and 21 and strips 24 and 25 are all joined into parts 9 and 11 of the seal, but part 10 of the seal joins together only the outer panel 20 and the inner edge of strip 25.

Figure 10:
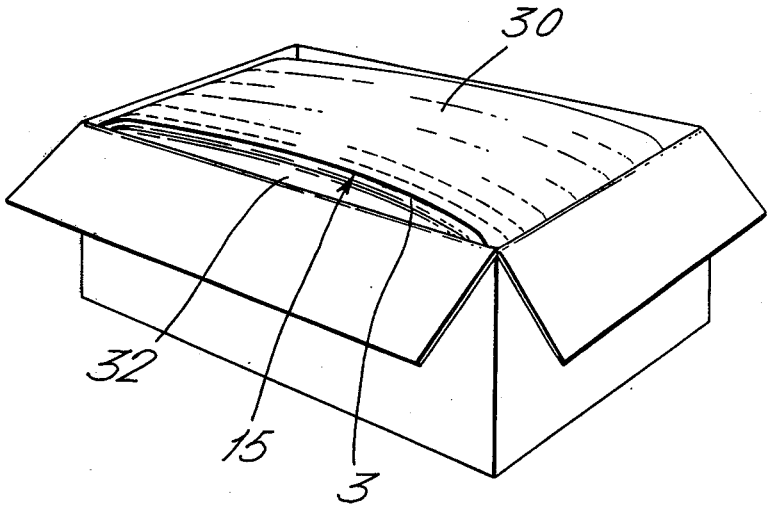
FIG. 10 shows a bag, which may be as illustrated by FIGS. 4 to 6 or by FIGS. 7 to 9, in use as a liner for a cardboard carton, the bag being filled with liquid.

In FIG. 10 : 30 is the bag, fully filled and contained in a carton, 31. The edge of the outer panel of the front wall is shown at 3, and the valve is located centrally, at 15. 32 is one of the side gussets of the bag.

Various modifications may be made in the bags particularly described. It is usually preferred to arrange the overlapping panels so that the valve opening is located within one half of the bag, with the valve passageway extending into or towards the other half. However, this arrangement is not essential, provided that sufficient space be left between the inner end of the passageway and the side of the bag facing it to allow for the insertion of a filling spout and free delivery of the filling material.

By way of example, a typical bag of the type illustrated by FIGS. 1 to 3 of the drawings has a length of 62.5 cms and a width of 51.0 cms, providing a capacity of 25 liters. A typical bag of the type illustrated by FIGS. 4 to 6 or 7 to 9 has a length of 62.0 cms, a flat width of 40.0 cms, and gusset folds 5.0 cms deep, also providing a capacity of 25 liters.

In the bags shown in the drawings the additional layer or layers extend down the whole length of the bag, and this arrangement has the advantage that the production of such bags involves only a very simple modification of the bag-making equipment. The valves may alternatively be formed by inserting a separate piece or pieces for each bag, in the region bridging the valve only, these pieces being joined to both the opposed panels at least by the said transverse seals. This alternative construction requires further equipment for manufacture of the bags, but has the advangtage of using less material.

For use as the plastics film forming at least one layer of the folded length that forms the bag, films of olefine polymer or copolymer, of polyurethane or of polyvinyl chloride, are very suitable. Film of low-density ethylene polymer or copolymer is particularly suitable because of its inherent heat-sealability, its toughness and its low cost.

The said additional layer or layers of flexible material included in the valve region are preferably, but not necessarily, of plastics material, and for bags intended to be suitable for containing liquids or semi-solids they are preferably of smooth-surfaced plastics film, advantageously of the same plastics material as the walls of the bag (since this will facilitate their inclusion in the seal) but thinner than the overall thickness of the bag wall, and, in the case of two-ply or multi-ply bags, preferably thinner than the plies. For other applications, for example to allow a limited amount of breathing in a bag filled with powder or granules, the additional layer or layers may be air-permeable. For example, they may be of a non-woven, bonded plastics fabric, a pile-surfaces plastics-film laminate, a foamed plastics film, or paper. The layer or layers are preferably heat-sealable to the panels of the bag, and the panels to each other, either directly or through a heat-sealable coating thereon. It is however possible to form the seals by means of an adhesive, for example by a hot-melt adhesive extruded as filaments or otherwise applied between the layers to be sealed.

The bags may be made by a continuous process, for example from flat plastics film or from tubular film of appropriate width, by continuously feeding a web thereof to a bag-making machine, after folding it to the appropriate form. When tubular film is used to make two-ply plastics-film bags of the type already described, one wall of the tubing may be slit longitudinally at a predetermined distance from one fold, and that fold thereafter unfolded, before the web itself is folded. In the longitudinally folded web that results, one ply is somewhat wider than the other, providing a single extending ply in the overlap. Such a web may of course alternatively be formed by longitudinally folding a length of single sheet of the film. The web, irrespective of its number of plies, may be folded by passing it over a suitable A-frame where it is folded longitudinally to form a tubing adapted to form the back wall and the overlapping front panels of the bags. The additional strip, folded strip or strips of film or other flexible material may be fed continuously into position between the overlapping portions or plies of the web. Alternatively, means may be provided for sealing separate pieces to the web at the required intervals. The area of overlap between the front panels is then provided at regular longitudinal intervals with the required longitudinal and transverse seals, which may be formed against a mandrel, to join them together and to provide the valve passageways of successive bags. The web is finally transversely sealed and cut at regular intervals to provide successive bags.

In a further modification the body of the bag is made of two or more plies of different materials, at least one ply being of a plastics film. For the other ply or plies, film of a different plastics material, or of any of the materials mentioned above as suitable alternatives for forming the added strips in the valve region, may be used. In such cases a web for forming the bags by a continuous process may be formed by lying one length of film or other material upon another, generally with the edges of the side forming the inner panel appropriately staggered. At the other side the edges may be joined together, at least in the regions that will be adjacent to the valve openings, or, preferably, the side edge of the layer that will form the outer layer of the bags may be folded over to enclose the edge of the other layer or layers, to be subsequently held in such position by the longitudinal and transverse seals in the finished bags, and to provide a fold at the edge of the valve opening.

I claim:

1. A valved bag formed from a length comprising two plies of plastics film, the length being folded and joined to provide a bag having one wall formed by overlapping panels, the ends of the bag being closed and the overlapping panels being joined together by a longitudinal seal located along the edge region of the outer panel, the longitudinal seal being interrupted to provide a valve opening with transverse seals at each side of the valve opening defining a passageway constituting a filling valve between the panels, the outer panel comprising the two plies with their edges coextensive and the inner panel comprising the two plies together with at least one layer of flexible material in addition to said two plies at least throughout the valve region, the two plies and the additional layer which comprise the inner panel being arranged with their edges staggered such that all three edges may contact the inner ply of the outer panel, the additional layer being joined to the two plies of the inner panel at least by the transverse seals and being located with at least one of the plies of the inner panel lying between the additional layer and the outer panel in the area of overlap.

2. A valved bag as claimed in claim 1 in which the additional layer of flexible material extends longitudinally from one closed end of the bag to the other.

3. A valved bag as claimed in claim 1 in which the additional layer of flexible material lies with one of its edges between said two plies of film of the inner panel and with its other edge projecting beyond the egde of the outer ply, but lying short of the edge of the inner ply, of the inner panel.

4. A valved bag as claimed in claim 3 in which said outer panel is edged by a fold.

5. A valved bag as claimed in claim 3 in which the edge of said inner ply of the inner panel is joined to the outer panel by a second longitudinal seal between the panels.

6. A valved bag as claimed in claim 1 in which two said additional layers of flexible material are provided by a J-folded strip of the material, the margin thereof that contains the fold being joined into said longitudinal seal and the two free edges thereof projecting unequally into the valve passageway.

7. A valved bag as claimed in claim 1 in which each said additional layer of flexible material is of smooth-surfaced plastics film thinner than the overall thickness of the bag wall.

8. A valved bag as claimed in claim 1 in which said additional layer or layers of flexible material are air-permeable.

9. A valved bag as claimed in claim 1, formed from a length comprising at least one layer of a plastics film and at least one layer of a different plastics film or of another flexible material.

10. A package comprising a valved bag as claimed in claim 1 and a liquid or a flowable semi-solid contained therein.

* * * * *